US009889700B2

(12) United States Patent
Chan et al.

(10) Patent No.: US 9,889,700 B2
(45) Date of Patent: Feb. 13, 2018

(54) MODULAR FOUNTAIN PENS USEABLE WITH INKS OF VARYING VISCOSITIES

(71) Applicant: Jessica Chan, Portland, OR (US)

(72) Inventors: Jessica Chan, Tigard, OR (US); Matthew Malone, Valencia, CA (US)

( * ) Notice: Subject to any disclaimer, the term of this patent is extended or adjusted under 35 U.S.C. 154(b) by 53 days.

(21) Appl. No.: 15/048,909

(22) Filed: Feb. 19, 2016

(65) Prior Publication Data

US 2016/0243879 A1 Aug. 25, 2016

Related U.S. Application Data

(60) Provisional application No. 62/118,392, filed on Feb. 19, 2015.

(51) Int. Cl.

| | |
|---|---|
| ***B43K 5/02*** | (2006.01) |
| ***B43K 1/00*** | (2006.01) |
| ***B43K 5/06*** | (2006.01) |
| ***B43K 5/18*** | (2006.01) |

(52) U.S. Cl.

CPC ..... *B43K 5/02* (2013.01); *B43K 1/00* (2013.01); *B43K 5/06* (2013.01); *B43K 5/18* (2013.01)

(58) Field of Classification Search

CPC combination set(s) only.
See application file for complete search history.

(56) References Cited

U.S. PATENT DOCUMENTS

| | | | | |
|---|---|---|---|---|
| 1,205,004 | A | 11/1916 | Matsui | |
| 2,035,378 | A | 3/1936 | Sayler | |
| 3,087,464 | A | 4/1963 | Wittnebert et al. | |
| 4,913,175 | A * | 4/1990 | Yokosuka | A45D 34/042 132/218 |
| 5,518,331 | A | 5/1996 | Moosmann et al. | |
| 7,073,967 | B2 * | 7/2006 | Choi | B43K 8/04 401/198 |
| 7,578,631 | B2 * | 8/2009 | Kurita | B43K 8/06 401/198 |
| 8,092,108 | B2 * | 1/2012 | Bainbridge | B05C 17/00516 401/171 |
| 2004/0162524 | A1 | 8/2004 | Schiff | |

FOREIGN PATENT DOCUMENTS

| | | |
|---|---|---|
| EP | 2628605 | 8/2013 |

* cited by examiner

*Primary Examiner* — David Walczak
(74) *Attorney, Agent, or Firm* — Schwabe, Williamson & Wyatt, P.C.

(57) ABSTRACT

Modular fountain pens useable with inks of varying viscosities that utilize a nib with exterior grooves for conveying ink, which removably fits into a coupler that places the nib in fluid communication with a reservoir by way of a central ink tube. The coupler removably secures into a housing, which is closed on its opposite end by a rotating end cap designed to engage the ink reservoir so as to allow the pen user to adjust the internal volume of the reservoir. The pen allows for quick assembly and disassembly, which allows the pen to be easily cleaned between uses to accommodate fluid inks that may leave heavy residues and also allows for the appearance of the pen to be changed according to user tastes. The use of a quick-removing nib allows for a double-tipped nib to be used, with different writing tips, and easy swapping by the pen user between writing tips.

20 Claims, 8 Drawing Sheets

MODULAR FOUNTAIN PENS USEABLE WITH INKS OF VARYING VISCOSITIES

CROSS REFERENCE TO RELATED APPLICATIONS

This application claims priority to U.S. Provisional Application Ser. No. 62/118,392, filed on 19 Feb. 2015, which is hereby incorporated by reference for all purposes.

BACKGROUND

The present disclosure relates generally to fountain pens. In particular, fountain pens that are capable of using a variety of different unconventional fluids for inks, such as wine, juice, soy sauce, etc., are described.

Fountain pens, developed from historical writing instruments such as the dip pen and quill, is comprised of an ink reservoir which feeds a nib, with both components retained in a housing that facilitates use of the pen. These basic components and the essential design of a fountain pen have been known for centuries. Despite the widespread adoption of more modern writing implements such as ball-point pens, fountain pens continue to enjoy a widespread usage by enthusiasts who employ them for artistic purposes, nostalgia, or to provide a more formal flourish in communications. The nib of a typical modern fountain pen is made of metal, which tapers to a pointed tip, and is split from the tip down a portion of its length. The split forms a channel that conveys ink from the pen's reservoir to the tip, to enable writing. Due to the split in the nib, writing with a typical fountain pen results in strokes of varying sizes depending upon the pressure used in writing. The greater the pressure used, the more the split opens at the tip, resulting in an increasingly broad stroke. This split also results in a fountain pen having a somewhat flattened contact point with the writing surface, which causes the pen's writing performance to vary depending upon the angle with which the writer holds the pen.

Dip pens, a predecessor to the fountain pen as mentioned above, can be purchased with nibs that are constructed using glass or a similarly hard material, shaped to a conical point. Instead of a split for conveying ink, multiple channels are cut into the surface of the nib, which act as small reservoirs. The pen is used by periodically dipping the nib into an ink well, which replenishes the ink held in the nib channels. These channels are often cut in a spiral fashion to increase the amount of ink the pen can retain between dips. The use of such a conical nib enables more consistent stroke widths, as the width of the nib in contact with the writing surface does not vary according to writing pressure. Furthermore, writing with a glass nib is slightly easier for left handed writers as compared to a fountain pen, as the nib comes to a slightly rounded conical point and is less sensitive to the angle at which the writer holds the pen.

Known fountain pens are not entirely satisfactory for the range of applications in which they are employed. For example, the performance of existing pens is highly dependent upon the viscosity and type of ink used. The small channels and passageways present on metal nib fountain pens can become clogged if unsuitable fluids are used for ink, resulting in diminished writing performance. Similarly, ink with too high a viscosity may not flow easily. With their simplistic design, dip pens are more immune to clogging, but lack the reservoir of a fountain pen that enables relatively continuous writing. Furthermore, currently available glass nib dib pens usually have a nib that is integral to the body of the pen. Should the nib break, the pen is essentially rendered useless and must be discarded.

Thus, there exists a need for improved fountain pens that improve upon and advance the design of known fountain and dip pens. Examples of new and useful fountain pens relevant to the needs existing in the field are discussed below.

Disclosure addressing one or more of the identified existing needs is provided in the detailed description below. Examples of references relevant to fountain pens include U.S. Pat. No. 1,205,004, and Chinese Patent CN 202491558 U. The complete disclosures of the above patents and patent applications are herein incorporated by reference for all purposes.

SUMMARY

The present disclosure is directed to a modular fountain pen useable with inks of varying viscosities. The fountain pen utilizes a nib with exterior grooves for conveying ink, which removably fits into a coupler that places the nib in fluid communication with a reservoir by way of a central ink tube. The coupler removably secures into a housing, which is closed on its opposite end by a rotating end cap designed to engage the ink reservoir so as to allow the pen user to adjust the internal volume of the reservoir. The use of O-rings to assemble the pen allows for quick assembly and disassembly, which further allows the pen to be easily cleaned between uses to accommodate fluid inks that may leave heavy residues. The quick assembly and disassembly also allows for the appearance of the pen to be changed according to user tastes. The use of a quick-removing nib allows for a double-tipped nib to be used, with different writing tips, and easy swapping by the pen user between writing tips.

DETAILED DESCRIPTION

The disclosed modular fountain pens will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various modular fountain pens are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1A:
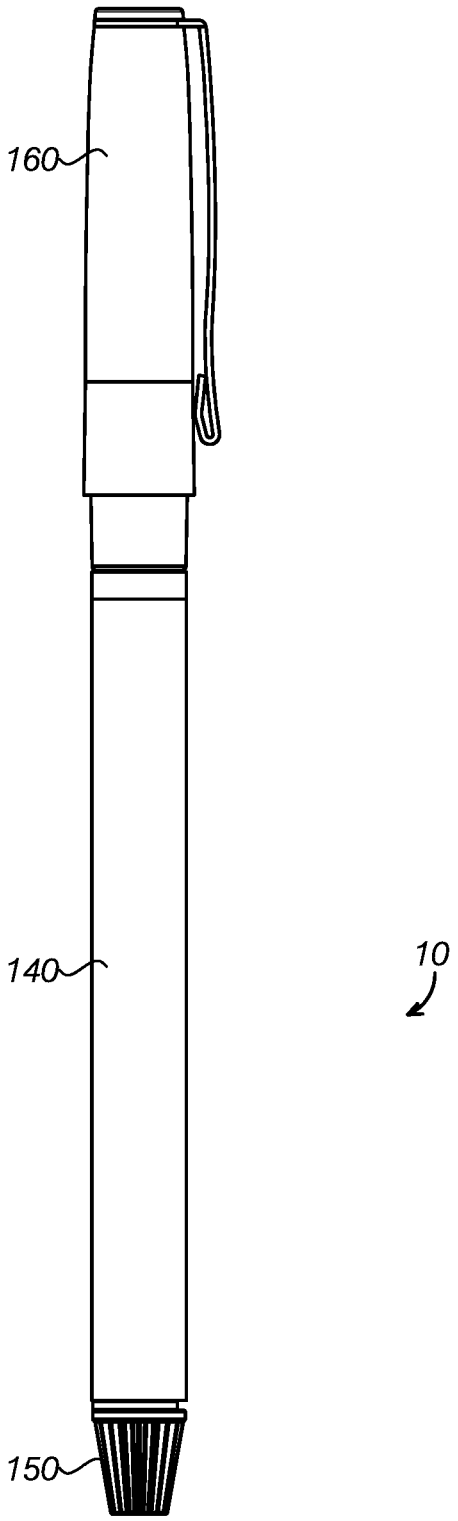
FIG. 1A is a side elevation view of a first example of a modular fountain pen.
Figure 1B:
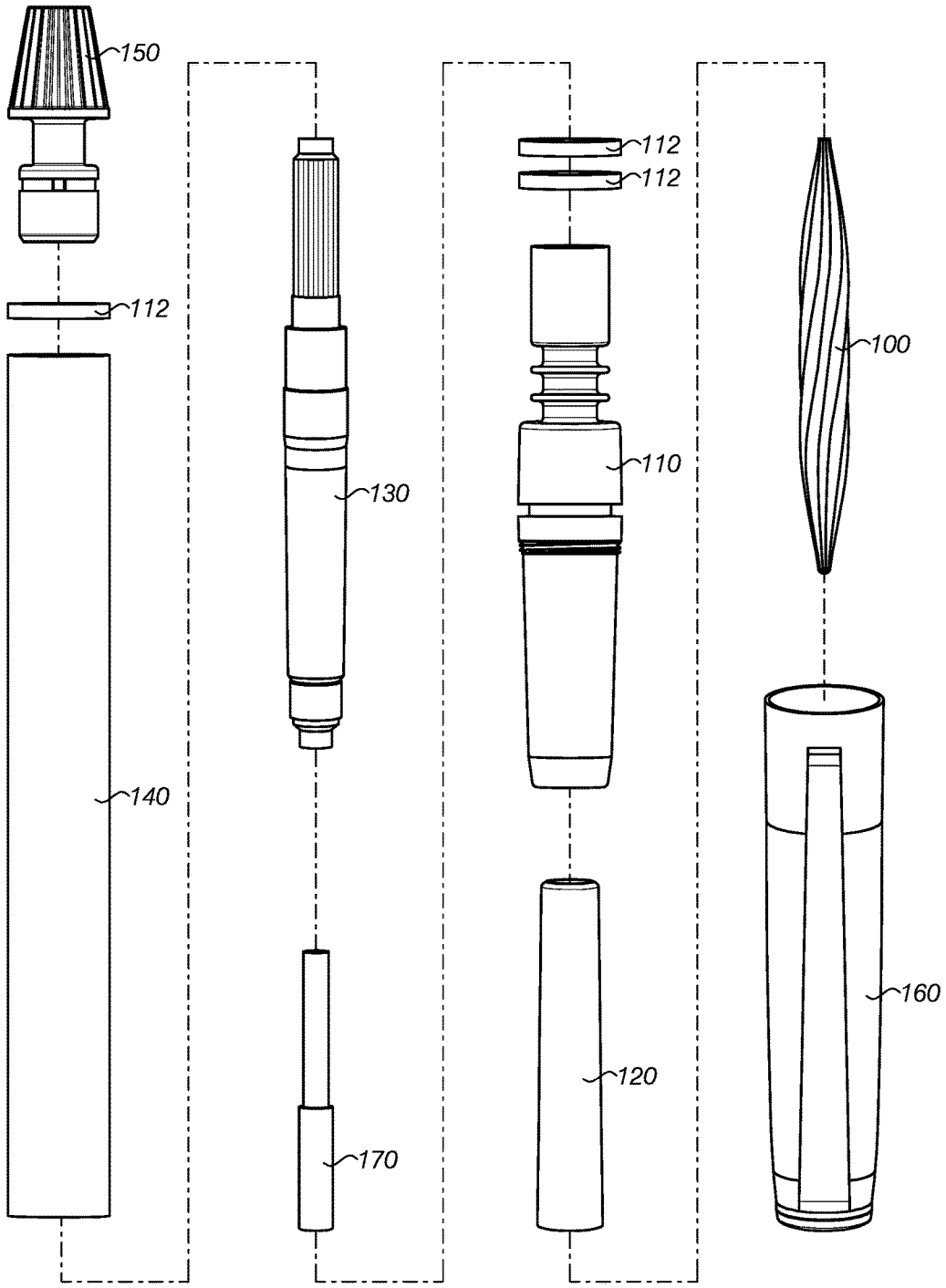
FIG. 1B is an exploded view of the modular fountain pen shown in FIG. 1A depicting he arrangement of it various components.

With reference to FIGS. 1A and 1B a first example of a fountain pen, fountain pen 10, will now be described. Fountain pen 10 functions to incorporate the reservoir and ease of use found in a traditional metal nib fountain pen with the flexibility of usage of the glass nib dip pen. Additionally or alternatively, fountain pen 10 can be used to provide a modular fluid ink writing system. The various components can be made independently replaceable, with variations produced that are tailored to specific uses and types of inks.

Fountain pen 10 addresses many of the shortcomings existing with conventional fountain pens. For example, the componentized design of fountain pen 10 enables the components that handle transfer of ink onto paper to be swapped according to the type of ink and writing surface that are used, thereby enabling use of a single pen with a greatly expanded variety of inks and writing media. The range of different inks available can also include nonconventional fluids, such as wine, soy sauce, juice, or any other staining fluid of suitable viscosity. Alternatively or in addition, the nib 100 can be swapped to change the shape of the nib tip to suit different writing styles, or if the nib 100 breaks for replacement. Further aiding in the use of a variety of non-conventional inks, the modular construction enables easy teardown of fountain pen 10 for cleaning, as various non-conventional inks may otherwise leave residues that build up over time and hinder performance.

Depicted in FIGS. 1A and 1B, the primary components of fountain pen 10 include a nib 100, coupler 110, ink reservoir 130, main body 140, and rotating end cap 150. Nib 100 is protected by a cap 160 that can be removably secured to fountain pen 10 when the pen is not in use. Nib 100 inserts into coupler 110 by way of a nib grip 120, which is in turn inserted into coupler 110. Ink stored inside reservoir 130 is conveyed to nib 100 by means of an ink tube 170. The various components can be held in place using a series of O-rings 112 to allow for easy tear-down and assembly.

Figure 2:
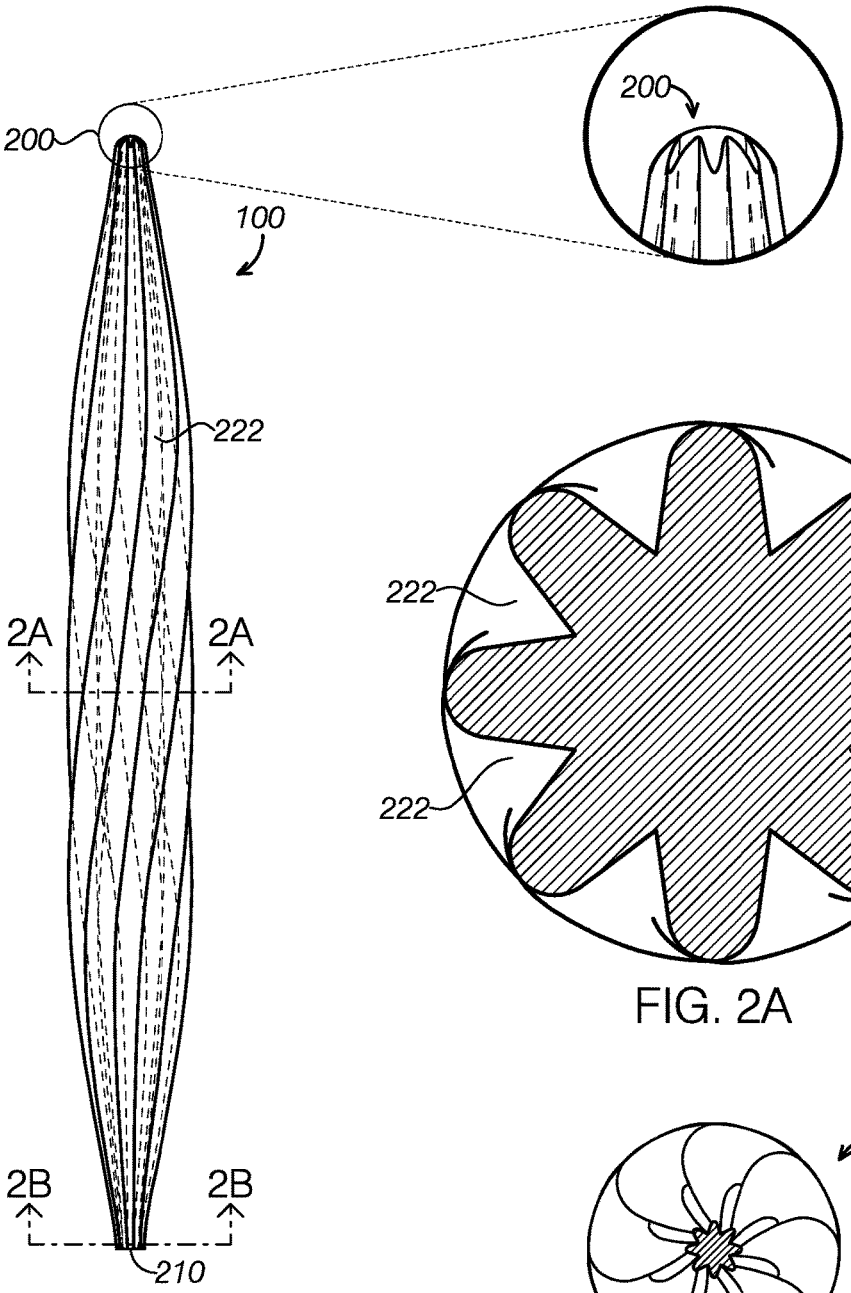
FIG. 2 is a side elevation view of the nib that is part of the modular fountain pen shown in FIG. 1B.

As can be seen in FIG. 2, nib 100 is double-ended, with a first end 200 and a second end 210. Each end can optionally be identical, allowing either end of the nib 100 to be used for writing, and also allowing the nib 100 to be inserted either direction into fountain pen 10. Running along the length of nib 100 are a series of ink channels 222, from the tip on first end 200 to the tip on second end 210, which deliver ink to the tip that is in contact with the writing surface. Nib 100 is ideally made of glass, plastic, metal, wood, foam, or any other material or combination of materials that is suitable for carrying ink to a writing surface and has durability sufficient to be used with the intended writing surfaces.

Figure 2A:
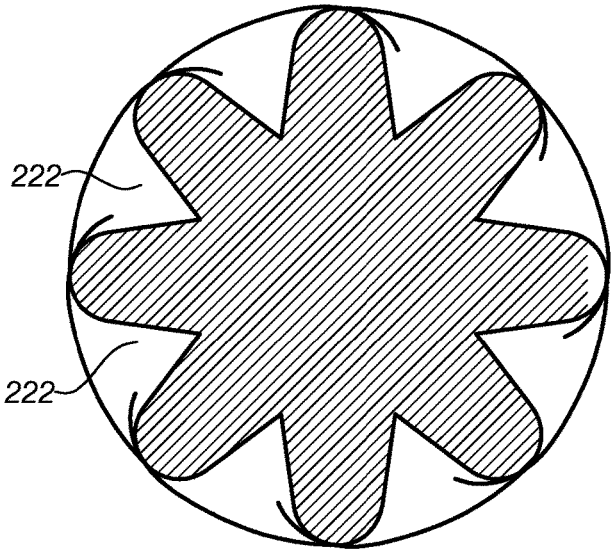
FIG. 2A is a cross section view from the center of the nib that is shown in FIG. 2.
Figure 2B:
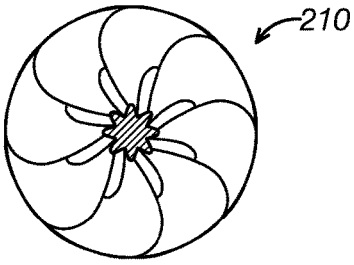
FIG. 2B is a cross section view from the tip of the nib that is shown in FIG. 2.

FIGS. 2 and 2A show the ink channels 222 preferably arranged in a spiral fashion, to increase their length and corresponding ink holding capacity, as well as to reduce or prevent excessive running of ink from the nib. The average number of channels ranges from 6 to 12 in total. As can be seen in FIG. 2, all or a portion of the ink channels 222 can alternatively be made straight, where first end 200 and second end 210 would have different arrangements of ink channels 222. Ink channels 222 must run to each of first end 200 and second end 210. FIG. 2B shows this arrangement in the context of second end 210, with ink channels 222 sizing down but terminating at the end so as to convey ink directly onto the writing surface. The width of each of the ink channels 222 can vary as necessary to suit the type of ink to be used. For example, narrower, deeper ink channels 222 may better accommodate thinner and more fluid inks, while shallower, wider ink channels 222 could be employed where thicker, more viscous ink is employed. Still other variations could implement ink channels 222 as holes or tubes that run inside the body of nib 100 and exit proximate to first end 200 and/or second end 210, thereby keeping ink from being exposed on the surface of nib 100.

The nib 100 depicted has approximate dimensions of 1 cm (10 mm) diameter, and 4 cm (40 mm) in length. However, these dimensions can be varied to suit the overall design of fountain pen 10. Other implementations may have a narrower or larger diameter as necessary to fit within the coupler 110 and nib holder 120. For more slender pen designs, a nib 100 diameter of less than 5 mm (0.5 cm) may be used. Nib 100 is placed into fountain pen 10 by inserting it into nib grip 120, and thence into coupler 110, which will be discussed in greater detail below. Ink channels 222 can be shaped around the midsection of nib 100, between first end 200 and second end 210, to facilitate retention of the nib 100 when it is inserted into nib grip 120. While the example nib 100 shown in FIG. 2 has differing first end 200, which is rounded, and second end 210, which is flat, these ends could be identical. In other variations, first end 200 and second end 210 may be tailored with different specific shapes to match a desired style of writing, e.g. first end 200 may have a broader point and second end 210 may have a finer point for varying stroke sizes. Other alternatives may have specific shaped tips, such as oblong, to enable the fountain pen 10 to be used for calligraphy. By way of example of shaping, the nib 100 may be tapered or ground on one end at an angle (e.g. 45 degrees) to enable a broader writing width. Still other alternatives may have second end 210 shaped to facilitate transfer of ink from the ink reservoir 130 to the tip of first end 200, rather than providing a second tip for writing. Where the first end 200 and second end 210 of nib 100 are both functional for writing, a user of fountain pen 10 may easily convert from one writing tip to a second style by removing the nib 100 from the nib grip 120, inverting it, and reinserting into the nib grip 120.

Figure 3:
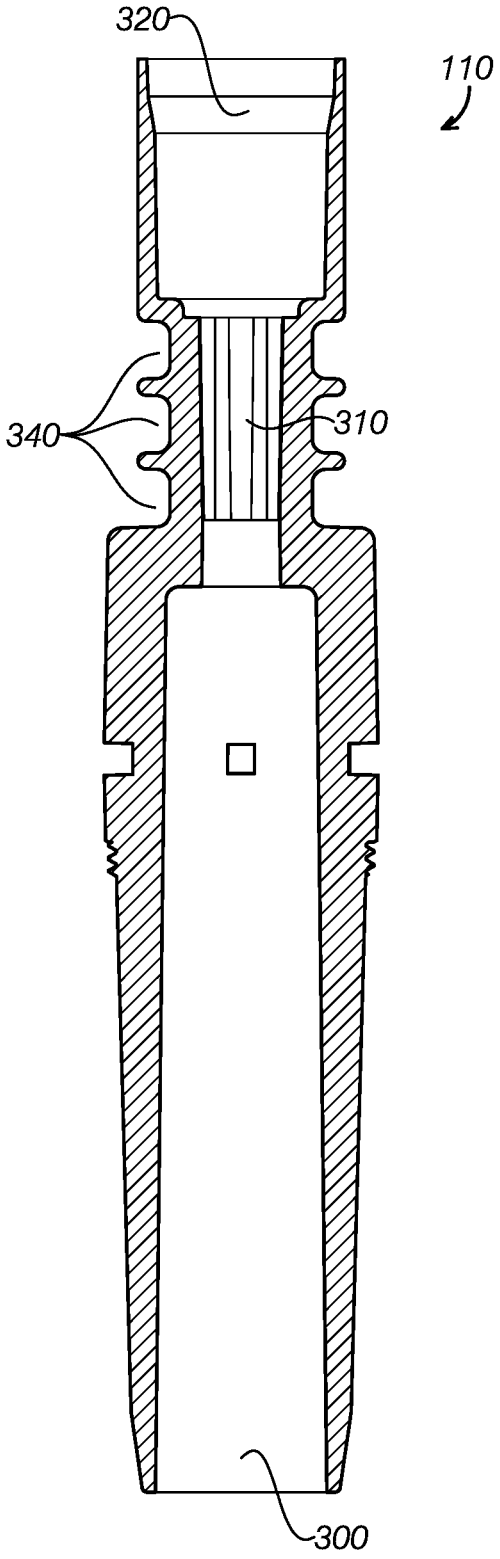
FIG. 3 is a cross section view of the coupler that is part of the modular fountain pen shown in FIG. 1B.

In the example shown in FIG. 3, coupler 110 is shown in greater detail. Coupler 110 includes a nib grip cavity 300, an ink delivery channel 310 which connects the top of nib grip cavity 300 to the bottom of reservoir cavity 320, and an attachment surface 340 which allows the coupler 110 to be removably affixed to main body 140 for assembly of the fountain pen 10. As assembled into the main body 140, coupler 110 serves as the lower half of fountain pen 10 as well as the grip for the pen user. Coupler 110 can be manufactured of plastic, metal, wood, composites, or any other material suitable to act as a grip surface and support the nib 100 and associated pressures experienced while being used for writing. The exterior of coupler 110 that is used as the grip for the user can optionally be further coated and/or shaped in such a fashion as to provide a more comfortable and contoured grip surface for writing. Into nib grip cavity 300 is inserted nib grip 120, which in turn receives nib 100 and holds nib 100 in place.

As can be seen in FIGS. 1B and 3, coupler 110 can be attached to main body 140 by way of attachment surface 340, which possesses a series of channels for accommodating O-rings 112. As coupler 110 is inserted into main body 140, O-rings 112 are compressed and hold coupler 110 securely into main body 140 by friction. Alternatively, attachment surface 340 can be implemented as a threaded surface, with a corresponding threaded portion on main body 140 into which coupler 110 is screwed. A person skilled in the relevant art will appreciate that threaded and O-ring press-fit methods of attachment are only two possible examples of ways to removably affix the coupler 110 to the main body 140. Any method for removably affixing the coupler 110 to the main body 140 in a fashion that allows for disassembly and reassembly, e.g. twist-lock, snapping mechanism, camming action, etc., can be utilized without deviating from the disclosed invention.

O-rings 112 are standard O-rings that are well known in the mechanical arts, and can be manufactured of any material such as rubber, silicone, plastic, viso-elastic polymer, or other similar material now known or later developed that provides for a compression fit friction seal.

Figure 4:
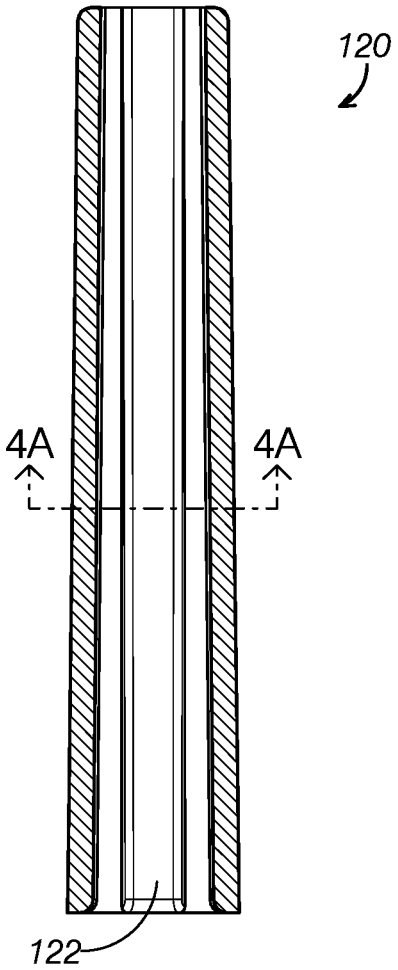
FIG. 4 is a cross section view of the nib grip that is part of the modular fountain pen shown in FIG. 1B.

FIG. 4 depicts nib grip 120 in a longitudinal cross-section. Nib grip 120 is substantially tubular, with a nib cavity 122 forming the center of nib grip 120. Nib grip 120 is inserted into nib grip cavity 300 into coupler 110. Nib 100 is in turn inserted into the nib cavity 122, which is shaped to retain the nib 100 by pressure. As described above, nib 100 may be complementarily shaped to facilitate being retained in the nib cavity 300. Nib holder 120 is shaped and constructed of a material so as to facilitate its retention within coupler 110, which likewise may be complementarily shaped to facilitate the retention of nib holder 120. Nib holder 120 may be manufactured of plastic, rubber, silicone, or any other material that is useful for retaining nib 100 under pressure, while simultaneously being retained in coupler 110. Alternatively, nib grip 120 can be made integral to or as part of the coupler 110.

Figure 4A:
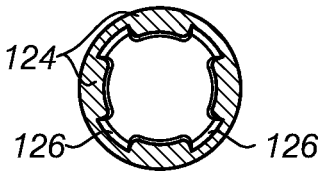
FIG. 4A is a cross section view through the center of the nib grip that is shown in FIG. 4.

FIG. 4A presents a cross-section across the axis of nib grip 120, demonstrating the internal structure of nib cavity 122. Specifically, the interior of nib cavity 122 includes a plurality of ridges 124, which are interspaced with grooves 126. Ridges 124 help improve upon the grip of nib 100, while also facilitating ink transfer. Ridges 124 and grooves 126 preferably run the length of nib cavity 122, but could only extend partially. Furthermore, while FIG. 4A presents a possible preferable internal structure for nib cavity 122, nib cavity could also be implemented with a smooth surface, omitting ridges 124 and grooves 126, or with more or less ridges, or potentially with any varying pattern that allows nib 100 to be removably secured within nib grip 120 in a fashion that promotes ink transfer across nib 100.

Figure 5:
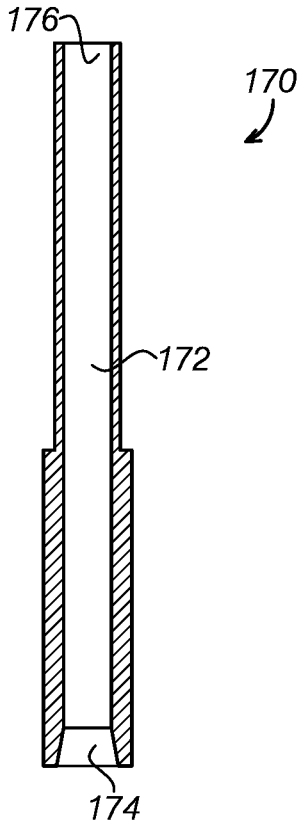
FIG. 5 is a cross section of the ink tube that is part of the modular fountain pen shown in FIG. 1B.

Referring to FIG. 5, ink tube 170 that conveys fluid ink from reservoir 130 to nib 100 is depicted. Ink tube 170, as its name suggests, is substantially a cylindrical tube with a hollow central channel 172 through which fluid ink moves. Ink tube 170 inserts into ink delivery channel 310 within coupler 110, and provides a reservoir interface 176 as well as a nib interface 174. Nib interface 174, as depicted in FIG. 5, is shown as a beveled surface at the end of hollow central channel 172, which is shaped to closely accommodate an end of nib 100 so as to convey ink to ink channels 222. The bevel angle preferably approximates the taper angle of nib 100, as can be seen in FIG. 2. Reservoir interface 176 is shaped to insert into reservoir 130 to receive ink into hollow central channel 172. Ink tube 170 is shaped to securely insert into ink delivery channel 310 and, in conjunction with the shape of the cavities in coupler 110, hold both nib 100 and reservoir 130 in a secure position in fluid communication to facilitate writing. Ink tube 170 can be constructed from metal, plastic, rubber, wood, composites, or any combination of the foregoing or any other suitable material now known or later developed that can withstand the stresses imposed by contact with nib 100 during writing, and which will convey ink from reservoir 130 to nib 100 without unduly restricting flow.

FIG. 1 also shows ink reservoir 130, which can be filled with a desired fluid for ink. Ink reservoir 130 interfaces with reservoir interface 176 for transfer of the ink to the top of nib 100 through ink delivery tube 170. In the example ink reservoir 130 shown in FIG. 1, the ink reservoir 130 has an ink control mechanism in the form of a piston assembly located opposite to where the ink reservoir 130 interfaces with ink tube 170, to facilitate filling of the ink reservoir 130, and to pressurize the ink reservoir 130 if necessary. In the selected reservoir 130, this piston assembly is controlled by a knob located on the end of reservoir 130, which raises or lowers the internal piston of reservoir 130 depending upon the direction in which the knob is rotated. As the internal piston is raised or lowered, the corresponding volume of reservoir 130 is increased or decreased, respectively, thereby enabling the reservoir to be filled or emptied. This type of reservoir mechanism is well known in the art. Other example ink control mechanisms may include a spring-powered piston, pneumatic piston, or air pressurization of the ink reservoir 130. In some possible implementations, ink reservoir 130 may optionally interface with reservoir interface 176 by way of a one-way valve mechanism located within the ink reservoir 130, in order to facilitate disassembly of the fountain pen 10 without the need to empty the ink reservoir 130 or risk spilling of any ink contained therein.

Figure 6:
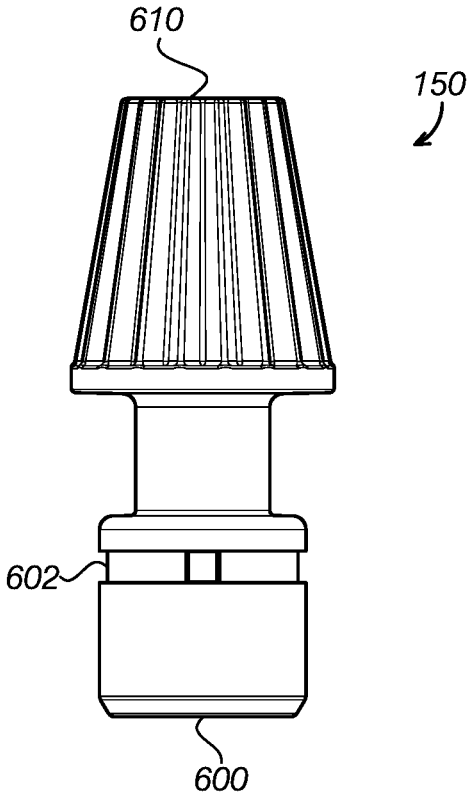
FIG. 6 is a side elevation view of the rotating end cap that is part of the modular fountain pen shown in FIG. 1B.

Turning attention to FIG. 6, rotating end cap 150 is shown. End cap 150 has an attachment surface 602 which is designed to allow end cap 150 to be removably affixed to the top end of main body 140. Attachment surface 602 is depicted as a channel for receiving an O-ring 112, but can be implemented using screw threads, press fit, or any other method that enables secure yet removable attachment to the top of main body 140. Inside end cap 150 is a mating surface 600 that can optionally contact ink reservoir 130 so as to allow any piston mechanism or other ink control mechanism in the ink reservoir 130 to be actuated without needing to disassemble fountain pen 10. Correspondingly, end cap 150 has a top surface 610 which allows the ink control mechanism to be actuated when the fountain pen 10 is assembled. Preferably, end cap 150 is comprised of an annular outer sleeve that contacts main body 140, into which a central assembly comprised of top surface 610 and mating surface 600 are inserted in such a fashion as to allow the central assembly to rotate. This rotational motion is conveyed via mating surface 600 to the mechanism in reservoir 130 that controls its volume, as described above. End cap 150 can be made of plastic, metal, wood, or any other material suitable for enclosing the fountain pen 10 and allowing for actuation of the ink control mechanism. A person skilled in the relevant art will appreciate that any method for removably affixing the end cap 150 to the main body 140 in a fashion that allows for disassembly and reassembly, e.g. twist-lock, snapping mechanism, camming action, etc., can be utilized without deviating from the disclosed invention.

Figure 7:
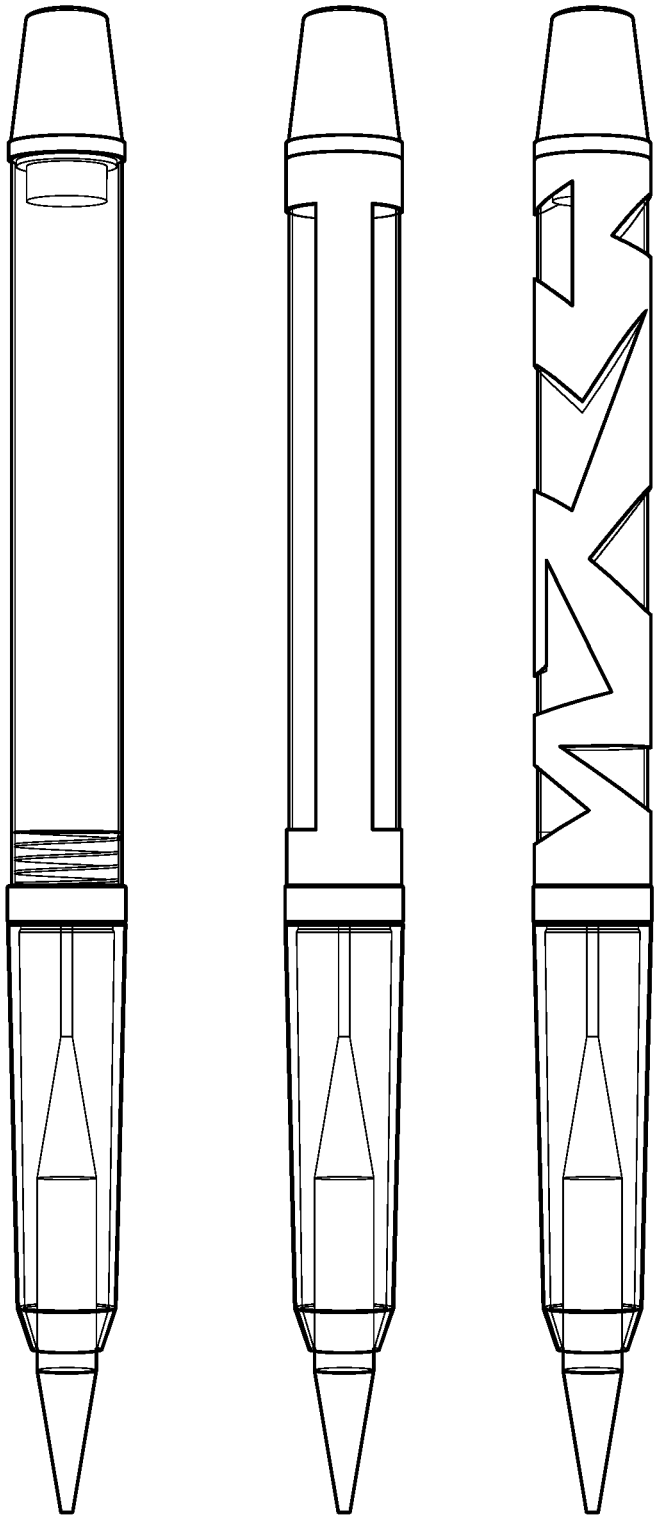
FIG. 7 is a series of side perspective views of possible variations of the exterior appearance of the modular fountain pen shown in FIG. 1A.

Examples of main body 140 are shown in FIG. 7. Main body 140 is essentially a hollow tube, with attachment surfaces located at either end. As depicted in FIG. 7, the exterior of the main body 140 can be fitted with a variety of decorations for aesthetic and/or functional purposes. The main body can be manufactured from plastic, metal, wood, composites, or any other material that is suitable for enduring typical stresses experienced by a fountain pen in use. Furthermore, owing to the modular nature of the fountain pen 10, the fountain pen 10 can be easily disassembled and the main body 140 replaced with another main body 140 with a different exterior appearance, allowing a user to quickly change the aesthetic appearance of the fountain pen 10. In alternative embodiments, the exterior of the main body 140 can be implemented as a separately removable sheath that fits over an inner tube to comprise main body 140, where the removable sheath can be swapped to change the aesthetic appearance of the fountain pen 10, with the interior tube being constructed of potentially different materials better suited to provide a durable structure to fountain pen 10. FIG. 7 shows some example usages of the fountain pen 10. In addition, different aesthetic appearances of fountain pen 10 are demonstrated, including a different, transparent appearance for coupler 110.

Assembly of fountain pen 10 is accomplished by inserting nib grip 120 into nib grip cavity 300, and then inserting ink tube 170 through nib grip 120 and through ink delivery channel 310 so as to protrude into both reservoir cavity 320 and nib grip cavity 300. Ink reservoir 130 is then inserted into reservoir cavity 320 of coupler 110 so as to engage reservoir interface 176. Coupler 110 with reservoir 130 is then inserted into the main body 140 so as to enclose the ink reservoir 130 inside main body 140. The coupler 110 is then removably affixed to one end of the main body 140, and rotating end cap 150 is removably affixed into the opposite end, with rotating end cap 150 potentially engaging an ink control mechanism located within the ink reservoir 130. Nib 100 is inserted into nib grip 120 in nib grip cavity 300. Cap 160 can be placed over nib 100 and the exposed end of coupler 110, and removably secured to either coupler 110 or main body 140. Cap 160 can be secured by a snap mechanism, press fit, threads, or any other method now known or later developed in the art for typically securing a cap to a pen when the pen is not in use.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A modular fountain pen, comprising:

a nib possessing a plurality of grooves that are disposed about the exterior of the nib and extend along its length;

a coupler, with a first end and a second end, with the nib removably inserted into the first end;

a reservoir removably inserted into the second end, the reservoir including a plunger for controlling the internal volume of the reservoir that is adjustable by rotating a knob on the reservoir; and a rotating end cap engaged with the knob such that the internal volume of the reservoir can be adjusted without removal of the reservoir from the coupler, wherein the reservoir is in fluid communication with the nib when the nib and reservoir are removably inserted into the coupler.

2. The modular fountain pen of claim 1, wherein the plurality of grooves are arranged in a substantially spiral configuration.

3. The modular fountain pen of claim 1, wherein the nib possesses two ends, with at least one end capable of being used for writing.

4. The modular fountain pen of claim 1, wherein the nib is removably held in place in the coupler by a nib grip which is inserted into the first cavity within the coupler.

5. The modular fountain pen of claim 4, wherein the nib grip possesses a smooth internal surface that is in contact with the nib when the nib is inserted into the coupler.

6. The modular fountain pen of claim 4, wherein the nib grip possesses a ridged internal surface, and where each of the ridges is in contact with the nib when the nib is inserted into the coupler.

7. The modular fountain pen of claim 1, further comprising a body tube that possesses an interior cavity, and wherein the reservoir is inserted into and removably secured to the body tube so that the body tube encloses the reservoir.

8. The modular fountain pen of claim 7, wherein:

the rotating end cap is inserted into the body tube opposite the coupler, and the rotating end cap engages with the external knob such that the internal volume of the reservoir can be adjusted without removal of the reservoir from the body tube.

9. The modular fountain pen of claim 1, further comprising a removable cap that encloses the nib.

10. The modular fountain pen of claim 1, further comprising an ink tube that inserts into the coupler and connects the reservoir to the nib, wherein one end of the ink tube penetrates into the reservoir when the reservoir is inserted into the coupler.

11. A modular fountain pen capable of using a variety of different fluids for inks, comprising:

a coupler that is substantially tubular and possesses two opposing cavities, wherein fluids can travel between the two opposing cavities;

a nib grip inserted into one of the two opposing cavities of the coupler, the nib grip including a nib grip cavity with an interior surface that is comprised of a plurality of ridges;

a nib with a tip shaped for writing on surfaces and possessing a plurality of grooves that extend from the tip along the length of the nib, the nib inserted into nib grip cavity and held in place by contact with the plurality of ridges of the interior surface of the nib grip;

a reservoir capable of holding a fluid and possessing a mechanism for varying the internal volume of the reservoir so that a fluid can be drawn into the reservoir, the reservoir inserted into the other of the two opposing cavities on the coupler;

an ink tube that inserts into the coupler and connects the two opposing cavities of the coupler, wherein one end of the ink tube penetrates into the reservoir when the reservoir is inserted into the coupler, such that fluid contained within the reservoir is conducted to the grooves of the nib; and a body tube that is hollow and cylindrical in shape, removably attaches to the coupler, and wherein the body tube encloses the reservoir when attached to the coupler.

12. The modular fountain pen of claim 11, wherein the nib is substantially cylindrical in shape and tapered at each end so as to form a tip at each end shaped for writing on surfaces, the plurality of grooves are disposed upon the surface of the nib and extend along the length of the nib connecting each end, and the plurality of grooves twist in a spiral about the center of the nib.

13. The modular fountain pen of claim 11, wherein the body tube is removably secured to the coupler by one or more O-rings.

14. The modular fountain pen of claim 13, further comprising a cap that removably attaches to the coupler and encloses the nib.

15. The modular fountain pen of claim 14, further comprising a rotating end cap that removably attaches to the body tube opposite the coupler, and which engages with the mechanism for varying the internal volume of the reservoir so that the internal volume of the reservoir may be adjusted with the modular fountain pen assembled.

16. A modular fountain pen capable of using a variety of different fluids for inks, comprising:

a coupler that is substantially tubular and possesses a first cavity and a second cavity, the first cavity opposing the second cavity, wherein fluids can travel between the two opposing cavities;

a nib with a tip shaped for writing on surfaces and possessing a plurality of grooves that extend from the tip along the length of the nib, the nib inserted into the first cavity;

a reservoir capable of holding a fluid and possessing a mechanism for varying the internal volume of the reservoir so that a fluid can be drawn into the reservoir, the reservoir inserted into the second cavity, wherein:

the nib is substantially cylindrical in shape and tapered at each end so as to form a tip at each end shaped for writing on surfaces, the plurality of grooves are disposed upon the surface of the nib and extend along the length of the nib connecting each end, and the plurality of grooves twist in a spiral about the center of the nib.

17. The modular fountain pen of claim 16, further comprising a rotating end cap, and wherein:

the mechanism for varying the internal volume of the reservoir comprises a plunger that is adjustable by rotating a knob on the reservoir, and the rotating end cap engages with the knob such that the internal volume of the reservoir can be adjusted without removal of the reservoir from the coupler.

18. The modular fountain pen of claim 16, further comprising a body tube that possesses an interior cavity, and wherein the reservoir is inserted into and removably secured to the body tube so that the body tube encloses the reservoir.

19. The modular fountain pen of claim 18, further comprising a rotating end cap, wherein:

the mechanism for varying the internal volume of the reservoir comprises a plunger that is adjustable by rotating a knob on the reservoir, and the rotating end cap engages with the knob such that the internal volume of the reservoir can be adjusted without removal of the reservoir from the body tube or coupler.

20. The modular fountain pen of claim 16, further comprising an ink tube that inserts into the coupler and connects the reservoir to the nib, wherein one end of the ink tube penetrates into the reservoir when the reservoir is inserted into the coupler.

* * * * *